US005354008A

United States Patent [19]

Honegger

[11] Patent Number: 5,354,008

[45] Date of Patent: Oct. 11, 1994

[54] STACKABLE WINDING CORE HAVING AXIAL PROJECTIONS

[75] Inventor: Werner Honegger, Tann Ruti, Switzerland

[73] Assignee: Ferag AG, Hinwil, Switzerland

[21] Appl. No.: 170,637

[22] Filed: Dec. 21, 1993

Related U.S. Application Data

[63] Continuation of Ser. No. 698,471, Apr. 26, 1991, abandoned.

[30] Foreign Application Priority Data

Apr. 26, 1990 [CH] Switzerland ..... 1427/90

[51] Int. Cl.[5] ..... B65H 75/18

[52] U.S. Cl. ..... 242/580; 242/605

[58] Field of Search ..... 242/59, 68, 68.5, 68.6, 242/71.8, 118.41; 206/389, 394, 403

[56] References Cited

U.S. PATENT DOCUMENTS

| | | | |
|---|---|---|---|
| 3,153,519 | 10/1964 | Jewell et al. | 242/118.41 X |
| 3,777,905 | 12/1973 | Morris | 206/394 |
| 3,997,125 | 12/1976 | Sato | 242/68.5 |
| 4,081,151 | 3/1978 | Ender et al. | 242/68.5 |
| 4,201,353 | 5/1980 | Schor | 242/68.5 |
| 4,340,188 | 7/1982 | Derendorf et al. | 242/68.5 |
| 4,341,357 | 7/1982 | De Fillippo | 242/68.5 |
| 4,641,795 | 2/1987 | Honegger | 242/59 |
| 4,651,943 | 3/1987 | Kawaguchi | 242/68.5 |
| 4,769,973 | 9/1988 | Reist | 53/430 |
| 4,795,105 | 1/1989 | Frei | 242/59 |
| 4,998,619 | 3/1991 | Sowa et al. | 242/130.2 |

FOREIGN PATENT DOCUMENTS

| | | | |
|---|---|---|---|
| 851946 | 7/1949 | Fed. Rep. of Germany . | |
| 559691 | 3/1975 | Switzerland | B65H 29/12 |

*Primary Examiner*—John M. Jillions

*Attorney, Agent, or Firm*—Oblon, Spivak, McClelland, Maier & Neustadt

[57] ABSTRACT

The winding body of the winding core has on its opposite ends projections, projecting in the direction of the longitudinal axis beyond the printing products wound up on the winding core, and recesses partially covered by the printing products. During the stacking of rolls one on top of the other in a tower-like manner, the projections of one winding core engage in the recesses of the winding core of the neighboring roll. During stacking, the wound up printing products of the rolls consequently come into contact with one another. Mutual slipping of the rolls during transport is thereby prevented.

12 Claims, 2 Drawing Sheets

STACKABLE WINDING CORE HAVING AXIAL PROJECTIONS

This application is a continuation of application Ser. No. 07/698,471, filed on Apr. 26, 1991, now abandoned.

BACKGROUND OF THE INVENTION

1. Field of the Invention

The present invention relates to a winding core for receiving printing products wound up together with a tensioned winding band and a roll with a winding core having a hollow-cylindrical winding body.

2. Discussion of the Background

It is known from EP-A 0 230 677, or corresponding U.S. Pat. No. 4,769,973, to stack in a tower-like manner rolls with a hollow-cylindrical winding core and with printing products wound up together with a tensioned winding band on the outer surface of the winding core and to transport and/or temporarily store them in this position. The winding cores are for this purpose of an identical or similar design, as is disclosed in EP-A 0 156 831 or corresponding U.S. Pat. No. 4,641,795. The winding core has in this case a smaller width than the wound up printing products, so that the winding core is set back from the end faces of the roll, in order to stack the rolls with their end faces flush against one another.

It is known furthermore from Swiss Patent Specification 559,691 to stack empty winding cores in a tower-like manner, for which purpose a stub shaft projecting at one end beyond the hub is inserted into the hub of each winding core, which stub shaft engages in the hub of the winding core lying underneath during stacking.

SUMMARY OF THE INVENTION

Setting out from this prior art, it is an object of the present invention to provide a winding core which allows for a tower-like stacking of rolls even when the winding core is wider than the printing products wound up thereupon and which permits space saving stable transporting and storing of a plurality of empty winding cores.

According to the invention, the winding body has on its axial side edges a number of projections extending in the axial direction and recesses extending in the axial direction. Due to the fact that the recesses are designed in such a way that they can receive the projections of another winding core, the projections of one winding core, projecting in the axial direction beyond the wound up printing products, engage in each case in the recesses of the neighboring winding core during tower-like stacking. The printing products of a roll thereby come into contact at an end face thereof with the roll lying underneath, which prevents destruction of the rolls by telescopic displacing of the printing products with respect to one another. In addition, proper, straight stacking of the rolls one on top of the other is ensured and a lateral displacement of the rolls with respect to one another is prevented, which is of significance in particular for the transport of rolls stacked one on top of the other. For transporting or storing, winding cores according to the invention can likewise be stacked one on top of the other in a tower-like manner, the continuations of one winding core in each case engaging in the recesses of the neighboring winding core. This tower-like stacking of the winding cores requires remarkably little space and is extremely stable, since the winding cores engage in one another in a claw coupling-like manner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
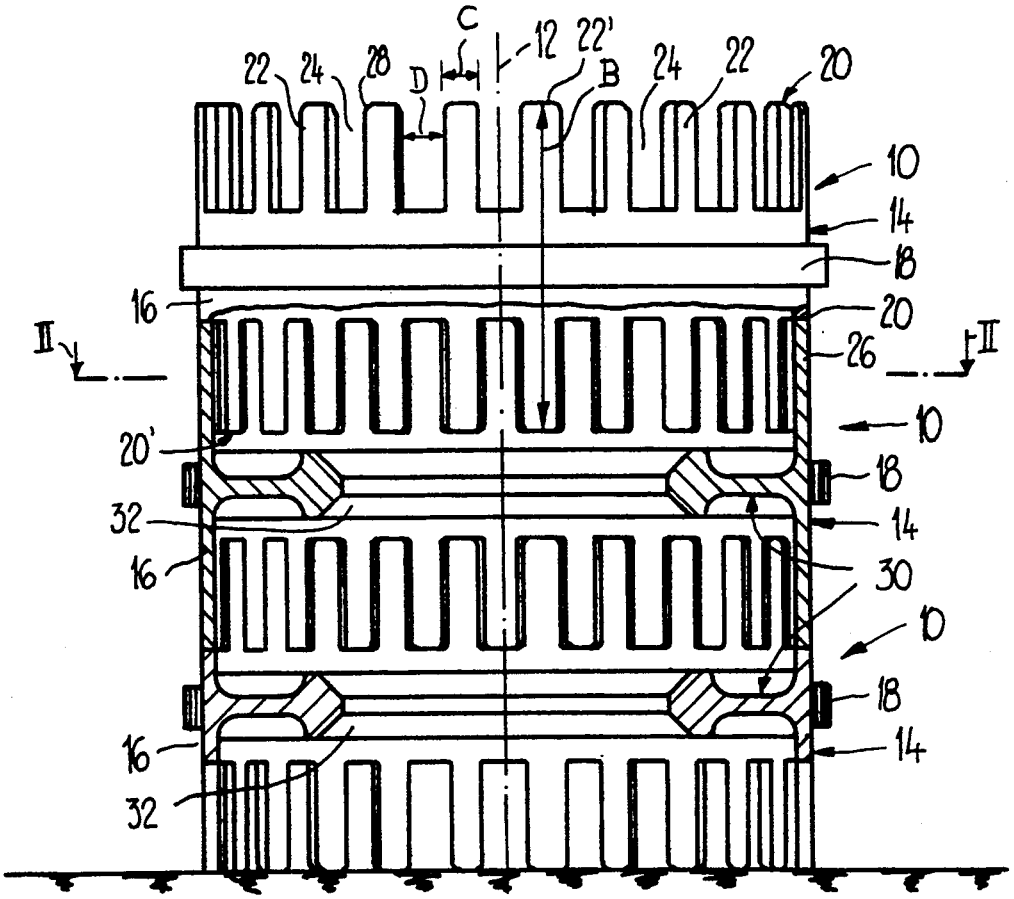
FIG. 1 shows in elevation and partially sectioned, three winding cores according to the invention, stacked one on top of the other in a tower-like manner.

Referring now to the drawings, wherein like reference numerals designate identical or corresponding parts throughout the several views, and more particularly to FIG. 1 thereof, FIG. 1 shows three identically designed winding bodies or cores 10, which are stacked one on top of the other in a tower-like manner with their longitudinal axis 12 running in the vertical direction. Each winding core 10 has a hollow-cylindrical winding body 14, the cylindrical outer surface of which is denoted by reference number 16. A winding band 18 is fastened at an end (not shown) to the winding body 14 and is wound up on the circumferential outer surface 16 of the winding body 14. The outer surface 16 is intended for carrying printing products wound up on the winding core 10 together with the tensioned winding band 18, as is generally known. The winding bodies 14 have on their axial side ends 20, 20', alternate projections or teeth 22 and recesses or gaps 24, which extend in the direction of the longitudinal axis 12. The recesses 24 are designed in such a way that they can receive the corresponding projections 22 of the neighboring winding core 10. During the tower-like stacking of a plurality of winding cores 10 one on top of the other, the projections 22 of one winding body 14 in each case engage in a claw coupling-like manner in the recesses 24 of the neighboring winding core or cores 10, which results in an extremely stable tower of winding cores 16 stacked one on top of the other, which is transportable without further stabilizing means. Furthermore, the overall tower height for a number of winding cores 10 is substantially less than the width B of the winding cores 10, as measured along longitudinal axis 12, multiplied by the number of winding cores 10 stacked one on top of the other.

The projections 22, provided at regular intervals, are formed on the winding body 14 and have a profile-shaped cross section 26 (see FIG. 2), which means that the cross section of the projections 22 is approximately constant over their length, as seen in the direction of the longitudinal axis 12. The width C of the projections 22, as measured in the circumferential direction, is less than the width D of the recesses 24, which corresponds to the distance between the projections 22. The projections 22 have in the transitional region between their free ends 22 and the recesses 24, beveled surfaces 28, in order to facilitate mutual guiding of the projections 22 into the recesses 24. It is, of course, also conceivable to design the projections 22 in such a way that their thickness, as seen in the radial direction, decreases in the direction toward the free ends 22'. However, it must be ensured that the outer surface 16, to which the projections 22 also contribute, is cylindrical, at least in the region in which the printing products come into contact. The number of projections 22 is advantageously chosen such that the width D of the recesses 24 is not too great, so that the printing products are also sufficiently supported in the region of the projections 22 and recesses 24.

The winding cores 10 have in the middle region thereof, as seen in the direction of the longitudinal axis 12, a peripheral web 30, projecting inward from the winding body 14 in the radial direction, onto which web bearing surfaces 32 are formed at the inner end region, in order to mount the winding core 10 rotatably on an appropriate bearing arrangement for the winding-up and unwinding of the printing products, or to grasp the winding core 10 by means of an appropriate device for transport and handling.

Figure 2:
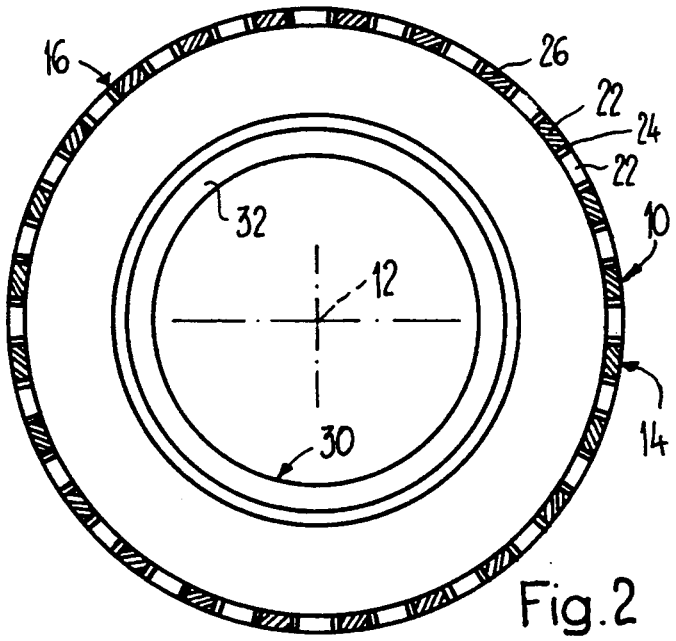
FIG. 2 shows a horizontal sectional view taken along line II—II of FIG. 1.

FIG. 2 shows a horizontal section along the line II—II of FIG. 1. The projections 22 of the middle winding core 10 of FIG. 1, projecting in the upward direction, are indicated as being unshaded in FIG. 2, whereas the projections 22 of the winding core 10 lying on top, engaging the recess 24 of the middle winding core 10, are half-shaded for better clarity.

Figure 3:
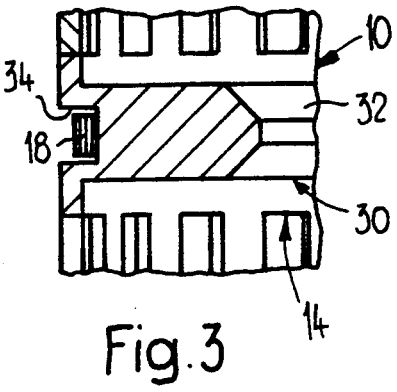
FIG. 3 shows an enlarged cut-out from FIG. 1, illustrating a further embodiment of the winding cores.

FIG. 3 shows an enlarged cut-out of FIG. 1, the winding core 10 being of a different design in the region of the web 30. The web 30, formed onto the winding body 14, has a uniform thickness from the winding body 14 up to the bearing surfaces 32. A circumferential groove, open toward the exterior in the radial direction, is denoted by 34, which groove penetrates the winding body 14 and the web 30. The winding band 18 is fastened at one end, not shown, to the winding core 10 in the region of the circumferential groove 34 and wound onto the winding core in the circumferential groove 34.

Figure 4:
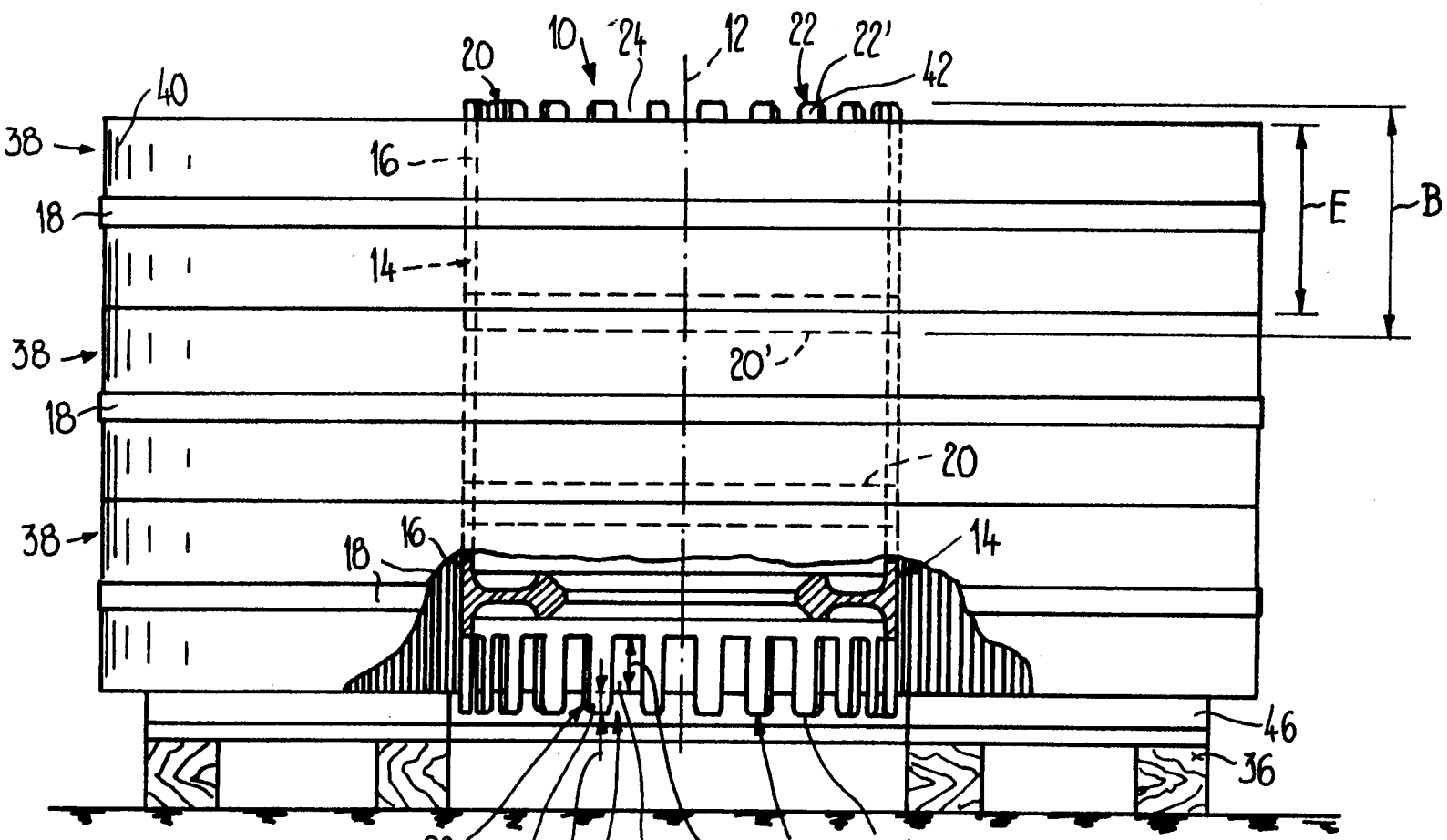
FIG. 4 shows three finished rolls, stacked one on top of the other in a tower-like manner, with winding cores according to the invention.

FIG. 4 shows three individual rolls 38, stacked in a tower-like manner on a pallet 36. The pallet 36 is a generally known standard pallet. Each roll 38 has a winding core 10, as described in detail above, and diagrammatically indicated printing products 40, such as newspapers, periodicals or the like, are wound up on the outer surface 16 of this winding core 10 in an imbricated formation together with the tensioned winding band 18. The winding band 18 is fastened at one end to the winding core 10 and is led on the outside around the outermost layer of printing products 40 and lashed in order to hold the roll 38 together. As measured in the direction of the longitudinal axis 12, the width B of each winding core 10 from the free end 22' of the projections 22 of the one side edge 20 to the free end 22' of the projections 22 of the other side edge 20' is greater than the width E of the printing products 40. A part of each projection 22, denoted by 42, consequently projects at the end face in the axial direction beyond the wound up printing products 40. It goes without saying that the width E does not necessarily mean the width of an individual printing product 40, but rather, if printing products 40 are wound up offset with respect to one another in the direction of the longitudinal axis 12, the entire dimension of all the printing products 40 wound up on a winding core 10, in the direction of the longitudinal axis 12, is to be understood. If the edges of the wound up, essentially rectangular printing products 40 do not run parallel or at right angles to the longitudinal axis 12, the width E is to be understood as being the distance, measured in the direction of the longitudinal axis 12, between the lateral corners of the printing products 40.

The length, as measured in the direction of the longitudinal axis 12, of the part 42 of the projections 22 which projects beyond the wound up printing products 40, is denoted by F. This length F is in any event at most equally as large as, but preferably smaller than the length G, as measured in the direction of the longitudinal axis 12, of the section 44 of the recesses 24 covered by the printing products 40. This ensures that the printing products 40 of a roll 38 come into contact at the end face with the printing products 40 of the neighboring roll 38 during stacking of the rolls 38.

On the pallet 36 there is provided a disk-shaped supporting ring 46, the thickness of which, as measured in the direction of the longitudinal axis 12, is greater than the length F of the projections 22 with their part 42 projecting beyond the wound up printing products 40. The printing products 40 of the bottom roll 38 consequently rest upon the supporting ring 46, which ensures retention of the shape of the rolls 38 even in the event of vibrations during transport. It is, of course, also conceivable to provide in the pallet 36 a clearance in which the projections 22 of the bottom winding core 10 engage. In this case, a supporting ring 46 may be dispensed with or may be of a thinner design.

Rolls 38 stacked one on top of the other in a tower-like manner with winding cores 10 according to the invention are consequently secured against mutual slipping during transport as well as against slipping in relation to the pallet 36.

Winding cores 10 according to the invention may, of course, also be used for winding up printing products 40 of which the width E is equal to or greater than the width B of the winding cores 10. In this case, the projections 22 in the direction of the longitudinal axis 12 do not project beyond the wound up printing products 40. Of course, printing products 40 of lesser width E may also be wound onto a winding core 10 according to the invention. In this case, stacking of the rolls 38 may only be possible by inserting a supporting disk between the rolls 38, to support the wound up or coiled printing products 40. In these cases, the winding cores 10 according to the invention still have the advantage that they can be stored without wound up printing products 40 in a space saving way by being stacked one on top of the other in a tower-like manner and, thus stabilized, can be transported. A winding core 10 according to the invention consequently allows the winding-up of formations of a great variety of widths E. The number of different winding cores can consequently be reduced to a minimum.

The projections and recesses may, of course, also be differently designed from those shown in the figures. For instance, it is conceivable to design the side edges of the winding body in a zig-zag shape.

Of course, the winding band does not have to be permanently fastened by one of its ends to the winding core 10; it is also possible to releasably fasten it to the winding core 10. Of course, the web may also be differently designed or a plurality of webs may be provided, or it is also possible to omit the web and replace it by some other bearing element to bear the empty winding core or the roll rotatably on a bearing arrangement.

What is claimed as new and desired to be secured by Letters Patent of the United States is:

1. A rotatable winding core for receiving a plurality of individual printed products, wound up together to form a tightly wound up roll of printed products, which comprises:

a ring-shaped winding body defining an axis and a median plane extending at right angles with respect to said axis;

a winding band provided for said rotatable winding core and, said winding band being wound in coils between coils of the wound-up printed products and said band being connected at one end with said winding body and being would on said winding body in the median plane thereof;

said winding body having a central portion about which said winding band is would to support the coils of the winding band and a substantially cylindrical circumferential outer surface on each side of said central portion to support the tightly wound up roll of printed products;

an inner peripheral web located in the inner periphery of central region of the winding body, said web running in a circumferential direction and protruding inwardly from the winding body in a radially inward direction;

the outer surface of at least one end of said winding body having a plurality of recessed formed therein extending in the axial direction toward said central portion and defining a plurality of projections, the circumferential width of said recesses being greater than the circumferential width of said projections for receiving the projections of a neighboring winding core;

wherein a plurality of winding cores are coaxially stacked one on top of the other in a tower-like manner, the projections of one winding core bearing against the central portion of an adjacent winding core when the winding cores are empty, and the end faces of the rolls of printed products bearing one against the other when the cores have wound up printed products wound thereon.

2. The winding core as claimed in claim 1, wherein the outer surface of the other end of the winding body includes a plurality of recesses defining a plurality of projections and the winding core is wider, as measured in the axial direction from free ends of the projections of one one end of the winding body to free ends of the projections of the other end of the winding body than a width dimension of the printed products, and wherein a section of the neighboring recesses overlapped by the printing products is at least as large as a part of the projections projecting beyond the printed products.

3. The winding core as claimed in claim 1, wherein the projections have, in a transitional region between the free ends and the neighboring recesses, beveled surfaces for introducing the projections of the neighboring winding core into the neighboring recesses.

4. The winding core as claimed in claim 1, wherein the projections are distributed evenly in the circumferential direction.

5. The winding core as claimed in claim 1, wherein the projections have a cross section which is approximately constant over the length thereof and the neighboring recesses of the projections are larger than the projections.

6. The winding core as claimed in claim 1, which comprises a bearing surface formed on the web for supporting the winding core during winding up and unwinding of the printing products.

7. The winding core as claimed in claim 1, wherein the winding body has a circumferential groove, open toward the exterior in a radial direction and wherein the winding band is received in the groove.

8. The roll assembly as claimed in claim 1, wherein the projections are distributed evenly in the circumferential direction.

9. The roll assembly as claimed in claim 1, wherein the winding cores each have substantially the same outside diameter and have substantially the same number of projections and neighboring recesses, for stacking one on top of the other.

10. The winding core as claimed in claim 1, wherein the cross-section of each of the projections is substantially constant along the length thereof.

11. A winding core as claimed in claim 1, wherein said peripheral web has an outer circumferential groove formed therein within which said winding band is positioned.

12. A winding core as claimed in claim 1, wherein said central portion comprises an unperforated portion.

* * * * *